United States Patent [19]

Williams

[11] 4,194,961

[45] Mar. 25, 1980

[54] ELECTRODE SPACER ELEMENT

[75] Inventor: Roy E. Williams, Mississauga, Canada

[73] Assignee: Erco Industries Limited, Islington, Canada

[21] Appl. No.: 12,594

[22] Filed: Feb. 16, 1979

[30] Foreign Application Priority Data

Sep. 29, 1978 [GB] United Kingdom ..... 38671/78

[51] Int. Cl.[2] ..... C25B 13/02

[52] U.S. Cl. ..... 204/286; 204/269; 204/270; 204/275; 204/278

[58] Field of Search ..... 204/286, 270, 275, 279, 204/297 R, 269, 278

[56] References Cited

U.S. PATENT DOCUMENTS 1,000,608 8/1911 Kenevel ..... 204/269

*Primary Examiner*—Howard S. Williams

*Attorney, Agent, or Firm*—Sim & McBurney

[57] ABSTRACT

A spacer element for spacing apart interleaved electrodes in an electrolytic cell is constructed of electrically non-conducting and corrosion-resistant material. The spacer element has an integral one-piece structure including a short cylindrical portion of length slightly greater than the thickness of the electrode plate onto which it is to be mounted and a circular head portion located at each end with an inner flat surface to engage the outer surface of the electrode plate with which the spacer element is assembled. Assembly of the spacer element with the electrode plate is effected in a unique procedure.

10 Claims, 4 Drawing Figures

ELECTRODE SPACER ELEMENT

FIELD OF INVENTION

The present invention is directed to the spacing of interleaved electrodes in an electrolytic cell.

BACKGROUND TO THE INVENTION

Cell structures utilizing interleaved anode and cathode elements between which passes a solution to be electrolyzed are known, such as, cells wherein sodium chlorate is formed by electrolysis of sodium chloride solution. To prevent shorting out of adjacent plates as would occur on their touching, means are generally employed to maintain the interleaved electrodes in spaced apart relationship.

Where one or both the electrodes is comparatively thin and flexible, some form of spacer element is used and such spacer elements typically take a two-part form, the two parts being interconnected through openings formed in the electrode.

It has generally been found, however, that such prior art spacer elements are unsatisfactory, in that they tend to separate during interleaving of the electrodes and hence, when the cell has been assembled many of the spacer elements are ineffective for their intended purpose.

SUMMARY OF INVENTION

In accordance with the present invention, there is provided an electrode spacer element constructed of electrically non-conducting and corrosion-resistant material and which is integrally formed as a one-piece element, so that separate interfitted parts cannot separate upon assembly, and thereby, the present invention overcomes the prior art problems mentioned above.

DESCRIPTION OF PREFERRED EMBODIMENT

Figure 1:
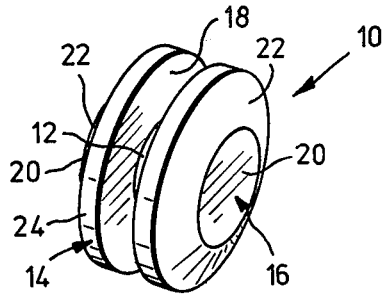
FIG. 1 is a perspective view of an electrode spacer element according to the present invention.

Referring to the drawings, an electrode spacer element 10 has an integrally-formed one-piece construction including a cylindrical shank portion 12 and two head portions 14 and 16 of circular cross section provided one at each end of the shank portion 12.

Each head portion 14, 16 has a planar inner surface 18, a planar outer surface 20 parallel to the planar inner surface 18, a bevelled rim 22, and a cylindrical portion 24 extending between the flat inner surface and the rim bevel 22.

The planar inner surfaces 18 of the head portions 14 and 16 are parallel to each other and spaced apart by the shank portion 12 a distance slightly greater than the thickness of the electrode sheet with which the spacer element 10 is to be assembled. In a thin flexible electrode plate for which the spacer elements 10 are particularly intended, the length of the shank portion may typically be about 1/16 to about ⅛ inch.

The planar inner surfaces 18 are intended to engage the outer surfaces of the electrode sheet when the spacer element 10 is assembled therewith, while the planar outer surfaces 20 are intended to engage adjacent electrode sheets to maintain spacing therebetween. The axial thickness of the head portions 14, 16 is that required to maintain the desired electrode spacing, typically about 1/16 to about ⅛ inch.

Each of the circular head portions 14, 16 is located with its centre of curvature located on the axis of the cylindrical portion 12 to provide a symmetrical structure.

While the shank portion 12 is illustrated as being cylindrical and represents the preferred shape for ease of manufacture and utilization, the cross-sectional shape thereof may be varied therefrom. For example, the shank portion 12 may have a square, hexagonal or other desired cross-sectional shape.

Similarly, the head portions 14 and 16 may vary in shape from the preferred circular cross section illustrated provided that the maximum lateral dimension thereof exceeds the maximum lateral dimension of the shank portion 12. For example, the head portions 14, 16 may have a square, oval, hexagonal or rectangular cross-sectional shape.

The spacer element 10 is constructed of a substantially rigid electrically non-conducting and corrosion-resistant material and may be formed by any convenient procedure, such as, machining, molding or the like. A suitable material of construction is polytetrafluoroethylene.

Figure 2:
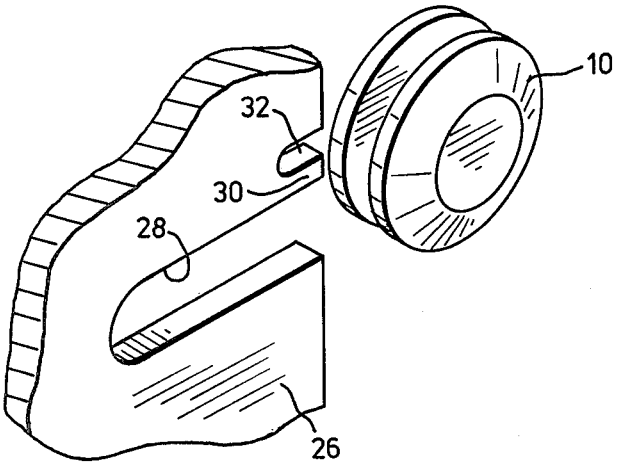
FIGS. 2 and 3 are perspective views of the electrode spacer element of FIG. 1 and an electrode plate illustrating assembly.

The spacer element 10 is assembled with an electrode plate 26 by the following procedure. A slot 28 is provided extending inwardly from one edge of the electrode plate 26, preferably perpendicularly thereto, and having a vertical dimension slightly larger than the diameter of the shank portion 12 to allow the spacer element 10 to slide into the slot 28, as seen in FIG. 2.

Figure 3:
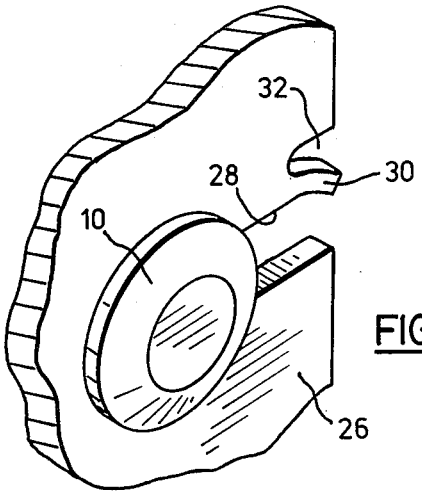

A tang 30 is formed between the slot 28 and a short slot 32 inwardly directed from the same edge of the plate 26 as the slot 28 and preferably formed parallel to the slot 28. When the spacer element 10 has been positioned in the slot 28, the tang 30 is bent downwardly and inwardly to constitute an interference to removal of the spacer element 10 from the slot 28, so that the spacer element 10 is restrainably located in the slot 28, as seen in FIG. 3.

The number of spacer elements 10 associated with each electrode plate 26 may vary widely depending on the size of the electrode plate. Usually, at least three such spacer elements are used, one located adjacent one end of the plate, one located adjacent the other end and one located intermediate the ends.

Figure 4:
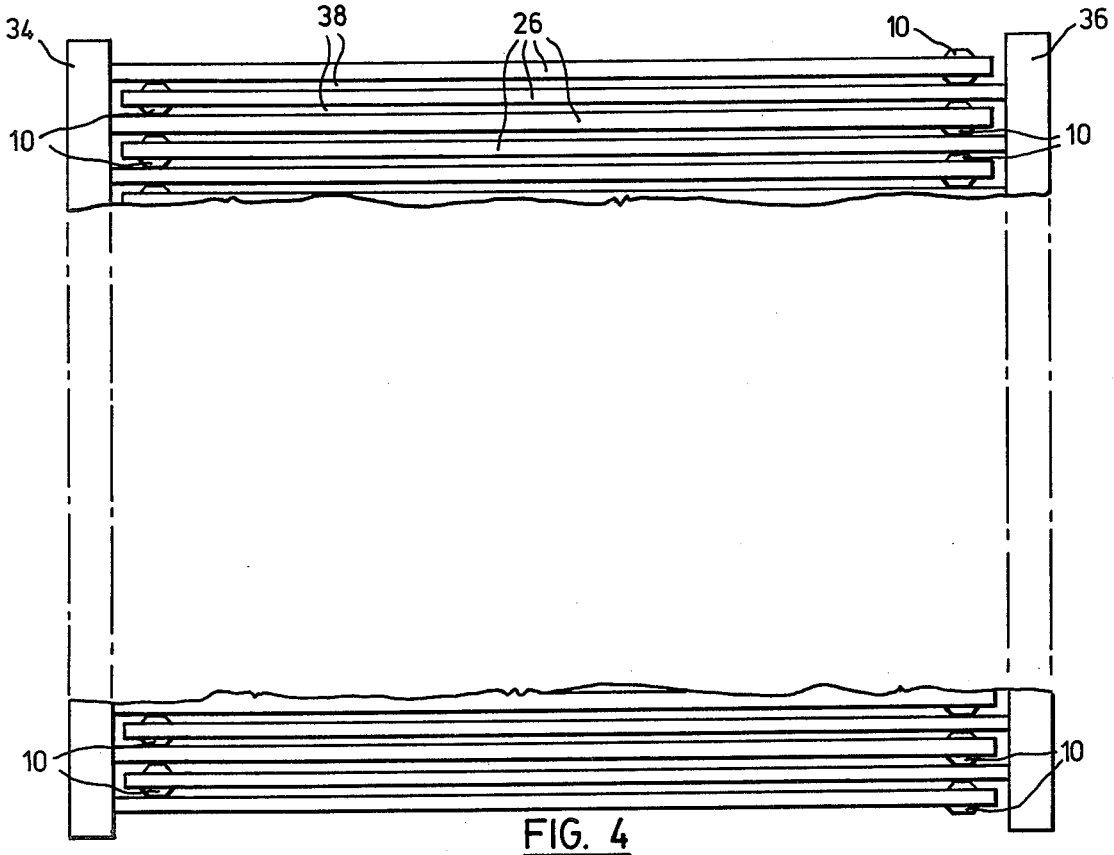
FIG. 4 is a plan view of a chlorate cell box containing electrode sheets spaced apart using the spacer elements of FIG. 1.

As seen in FIG. 4, in a chlorate cell box assembly, the spacer elements may be located at the vertical edge of a plurality of electrode plates 26 remote from a vertical backing plate 34 or 36 to which they are mounted and the electrode plates extending from the backing plates 34, 36 are interleaved with each other to provide a cell box having a plurality of narrow vertical channels 38 through which electrolyte flows for electrolysis between the anode and cathode plates.

The use of integrally-formed spacer elements 10 permits ready interleaving of the thin electrode sheets 26 of an anode electrode bundle with those of a cathode electrode bundle, the bevelled rim 22 assisting in the interleaving step, to result in the assembled cell structure of FIG. 4.

SUMMARY OF DISCLOSURE

The present invention, therefore, provides a one-piece spacer element for thin electrode plates which has many benefits when compared with the prior art. Modifications are possible within the scope of the invention.

I claim:

1. In an assembly of closely-spaced electrode plates in an electrolytic cell, a plurality of electrically-insulating one-piece spacer elements mounted on said plates and spacing the electrode plates apart from each other, each of said spacer elements comprising:

an elongate shank portion of length slightly greater than the thickness of said electrode plate, and a head portion integrally formed at each end of said shank portion and having an inner substantially planar surface to engage the adjacent outer surface of said electrode plate when assembled therewith and an outer substantially planar surface substantially parallel to said inner surface to engage an electrode plate to be spaced from said first-mentioned electrode plate, each said head portion having a maximum transverse dimension greater than the maximum transverse dimension of said shank portion.

2. The spacer element of claim 1 wherein said shank portion is generally cylindrical in cross section.

3. The spacer element of claim 1 or 2 wherein each said head portion is of generally circular cross section and has its centre of curvature located substantially on the axis of said shank portion.

4. The spacer element of claim 3 wherein each said circular head portion has a bevelled rim and a planar outer surface parallel to said planar inner surface.

5. An assembly for use in an electrolytic cell, comprising:

an electrode plate, and a plurality of electrically-insulating spacer elements mounted thereon for spacing the electrode plate apart from other electrode plates in said cell, each of said spacer elements having an elongate shank portion of length slightly greater than the thickness of said electrode plate and extending through a slot formed in said plate, said slot extending inwardly from one edge thereof, each of said spacer elements having a head portion integrally formed at each end of said shank portion and having an inner planar surface engaging the adjacent outer surface of the electrode plate and a planar outer surface parallel to said planar inner surface, each of said head portions having a maximum transverse dimension greater than the maximum transverse dimension of said shank portion and of the width of the slot and a maximum thickness corresponding to the spacing desired between electrode plates in said cell, said slot having interference means associated therewith to prevent removal of said spacer element from said slot.

6. The assembly of claim 5 wherein said shank portion is cylindrical and has a diameter slightly smaller than the width of said slot and each of said head portions are circular with the centre of curvature located substantially on the axis of said shank portion.

7. The assembly of claim 6 wherein each of said head portions has a bevelled edge around said planar outer surface.

8. The assembly of claim 5, 6 or 7 wherein said interference means is constituted by a tang bent inwardly of said slot and constituted by the portion of metal located between said slot and a shorter slot formed parallel thereto and closely spaced therefrom.

9. The assembly of claim 8 wherein said slot and shorter slot are formed generally perpendicular to said one edge.

10. The assembly of claim 5 wherein said electrode plate has a thickness of about 1/16 to about $\frac{1}{8}$ inch.

* * * * *